US006165081A

United States Patent [19]

Chou

[11] Patent Number: 6,165,081

[45] Date of Patent: Dec. 26, 2000

[54] GOLF CLUB HEAD FOR CONTROLLING LAUNCH VELOCITY OF A BALL

[76] Inventor: Pei Chi Chou, 227 Hemlock Rd., Wynnewood, Pa. 19096

[21] Appl. No.: 09/257,089

[22] Filed: Feb. 24, 1999

[51] Int. Cl.[7] ..... A63B 53/04

[52] U.S. Cl. ..... 473/329; 473/342; 473/345

[58] Field of Search ..... 473/325, 329, 473/332, 333, 342, 345, 350

[56] References Cited

U.S. PATENT DOCUMENTS 3,989,248 11/1976 Campau .
4,398,965 8/1983 Campau .
5,499,814 3/1996 Lu .
5,743,813 4/1998 Chen et al. .
5,863,261 1/1999 Eggiman .

*Primary Examiner*—William M. Pierce
*Attorney, Agent, or Firm*—Ratner & Prestia

[57] ABSTRACT

A golf club head having a stopper plate disposed at a front end and a trampoline plate disposed forwardly of the stopper plate. The trampoline plate deflects in a direction toward the stopper plate and rebounds in a direction away from the stopper plate when striking a golf ball. The stopper plate is disposed at a predetermined distance from the trampoline plate for arresting a predetermined deflection of the trampoline plate.

18 Claims, 7 Drawing Sheets

GOLF CLUB HEAD FOR CONTROLLING LAUNCH VELOCITY OF A BALL

FIELD OF THE INVENTION

The present invention relates, in general, to a golf club and, more specifically, to a golf club head for controlling launch velocity of a golf ball.

BACKGROUND OF THE INVENTION

With the availability of new and improved materials, golf clubs are continuously being made stronger and lighter to provide maximum flying distance to the ball. One of the difficulties in designing a golf club is the "trampoline effect" of the golf club head, which increases the launch velocity of a ball. The club head typically has a face plate that deforms when the face plate strikes the ball. Behaving like a spring, the face plate rebounds to give the ball a higher launch velocity. This is known as the trampoline effect. Higher face plate deformation may be realized by using a thin face plate with materials that have low stiffness (Young's modulus) and high strength. Materials that have these properties include titanium, a new alloy and glass or graphite reinforced composite materials.

Recently the U.S. Golf Association (USGA) has determined that the trampoline effect does occur. In order to preserve the game as a game of skill, the USGA has resolved not to permit technology to overwhelm the game. In October 1998, the USGA has adopted a regulation that limits excessive launch velocity of a golf ball. In essence, the rule stipulates that any club head, which impacts a golf ball at a velocity of 160 ft/sec will be considered nonconforming, if it has a coefficient of restitution greater than 0.83.

A typical golf club head using new materials is disclosed in U.S. Pat. No. 5,064,197. The disclosure describes a method to adjust the sound characteristics of a metal "wood" club head upon impacting a golf ball. The club head includes a pair of chambers filled with air, liquid or solid. The forward chamber is covered with a plate formed of metal that is designed to maximize the flying distance of the ball. The disclosure suggests that if the face plate is made thinner, a trampoline-like effect may be produced that may enhance the propulsion effects of the club head against the struck ball. There is no further disclosure in this patent, however, why such propulsion effects occur or how these effects may be tuned to the individual golfer.

U.S. Pat. No. 5,807,190 discusses use of various materials in golf club heads to achieve greater distance and more control over a ball. Since mechanical characteristics of the club face determines the trajectory and distance of the ball, the Patent discloses that controlling the characteristics of the face plate is the key to controlling speed and distance of the ball. The striking face of the golf club includes different zones of material. One or more of the zones may be of material having a first predetermined modulus of elasticity, and one or more of the other zones may be of material having a second predetermined modulus of elasticity. These zones may be made from a unitary piece of material or from different materials, such as titanium and stainless steel. These materials may be applied to the club face monolithically or as inserts, and include polymers, ceramics and metals. The most common materials are stainless steel, BeCu, titanium alloys and shape memory materials, such as NiTi and copper based alloys. U.S. Pat. No. 5,807,190 is incorporated herein by reference for its teachings of applying various materials to the face of a club to control speed and distance of a ball.

Another patent incorporated herein by reference for its teachings of adjusting a club face to the skill level of the golfer is U.S. Pat. No. 5,505,453. This reference is directed to a strike plate of desired thickness having a bulbous portion formed on a rear face of the strike plate. A removable tennis racket-like head with a plurality of tension strings is mounted behind the strike plate. The tension strings may be fabricated from high strength materials such as carbon, fiberglass, stainless steel, etc. In this manner, the golf club head may be "tuned" to the individual skill levels of the players. By selecting different materials and structures for the face plate of the golf club head, the launch velocity of the ball may be controlled.

SUMMARY OF THE INVENTION

The present invention provides a golf club head having a stopper plate disposed at a front end. A trampoline plate is disposed a predetermined distance forwardly of the stopper plate for forming a gap in between. The trampoline plate deflects in a direction toward the stopper plate and rebounds in a direction away from the stopper plate when impacting a golf ball. The stopper plate arrests the deflection of the trampoline plate when striking a golf ball with a first impact velocity. The trampoline plate deflects freely when striking the golf ball with a second impact velocity. The second impact velocity is lower than the first impact velocity.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. Included in the drawing are the following figures.

DETAILED DESCRIPTION OF THE INVENTION

The invention allows the mechanical properties of the striking face of a golf club to be controlled and varied. In an exemplary embodiment, control of the striking face is varied so that it does not violate the USGA maximum launch velocity. An exemplary embodiment of the invention will be described using the USGA requirement.

Figure 1:
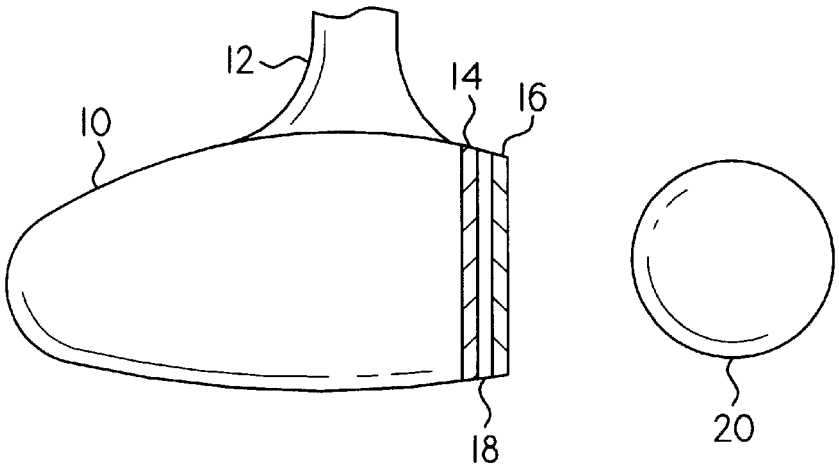
FIG. 1 is a cross-sectional view of a driver club head of the present invention prior to impacting a golf ball.

Use of the invention provides a coefficient of restitution of 0.83 to the golf club when impacting a ball at 160 ft/sec, hence satisfying current USGA regulations. With a lower impact velocity, however, which is consistent with a non-professional player, the club head provides a coefficient of restitution that is higher than that of a conventional club head and higher than 0.83. The invention includes a club head that has two plates separated by a gap space, as shown in FIG. 1. As shown, trampoline plate 16 is disposed at the hitting or striking side of a golf club head. The body of the golf club head is generally identified as 10 and has a hosel 12 projecting upwardly from the top wall of the club head in a conventional manner. The trampoline plate 16 has a striking surface for hitting a golf ball 20. As will be described more fully, the thickness, shape and resiliency of trampoline plate 16 may be varied, depending on use of the club and on the resiliency and hardness of its material.

Disposed rearwardly of trampoline plate 16 is stopper plate 14. Trampoline plate 16 and stopper plate 14 are separated by gap 18. Stopper plate 14 is stiff and arrests the deflection of the trampoline plate. In this manner, the club head may provide a coefficient of restitution of 0.83 when impacting a ball at 160 ft/sec. Under moderate impact speed (lower than 160 ft/sec), which is consistent with the non-professional golfer, trampoline plate 16 deflects freely and produces a ball launch velocity higher then a conventional club head that experiences little or no trampoline effect. When the impact speed is high in the hands of a professional player, however, the trampoline plate's deflection is arrested by the stopper plate. Consequently, the maximum launch velocity and the coefficient of restitution remains within USGA regulation limits. The invention thus allows the trampoline effect to increase the ball launch velocity for the average golfer, but does not help the professional golfer, all within the USGA regulations.

Figure 2:
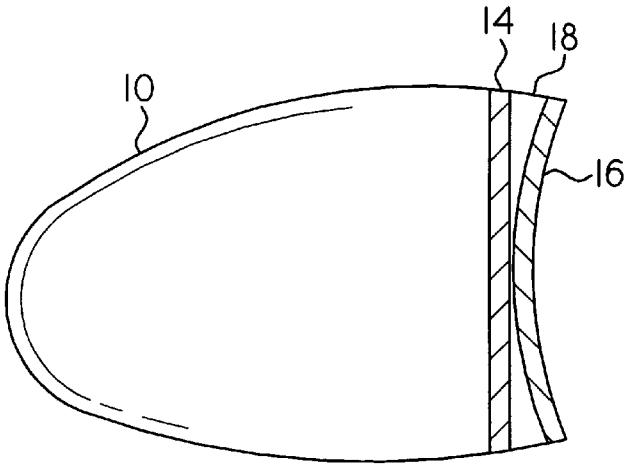
FIG. 2 is a cross-sectional view of the driver club head of the present invention including a trampoline plate deflected after impacting the golf ball.
Figure 3:
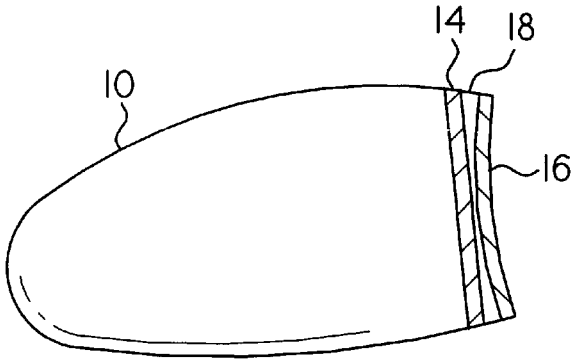
FIG. 3 is a cross-sectional view of the driver club head of the present invention including a trampoline plate being limited from deflecting upon impacting the golf ball.

Referring now to FIGS. 1–3, trampoline plate 16 is shown in three different positions. Just prior to striking ball 20, trampoline plate 16 is at a rest position and is spaced from stopper plate 14 by a predetermined width or gap 18. At moderate impact speed, the trampoline plate deflects freely, as shown in FIG. 2. That is, upon striking the ball (not shown) trampoline plate 16 deforms and deflects inwardly into gap 18. Due to resiliency, trampoline plate 16 rebounds to give the ball a higher launch velocity. The stopper plate is inactive during moderate impact speed, and behaves transparently to the spring-like action of the trampoline plate. At the USGA specified high impact speed of 160 ft/sec, however, the deflection of the trampoline plate is arrested by the stopper plate, as shown in FIG. 3.

More specifically, the stopper plate is inactive at impact velocities below 120–140 ft/sec. At impact velocities of 120–140 ft/sec the gap width is such that upon deflection the trampoline plate just touches the stopper plate. At impact velocities greater than 120–140 ft/sec, particularly at 160 ft/sec, the stopper plate arrests any further deflection of the trampoline plate.

The trampoline effect is dependent on the characteristics of the trampoline plate. Depending on the materials used, the effect is usually more pronounced if the plate is thin. Compared to a thick trampoline plate, a thin plate deflects more during ball impact, and rebounds more to give the ball a higher launch velocity. The energy loss during impact is mostly in the ball, due to the viscosity and large deformation of the ball. In order to reduce energy loss, deformation of the ball may be reduced. This is achievable by increasing the deformation of the trampoline plate which, in turn, results in reducing the deformation of the ball. Higher deformation, or deflection, in the trampoline plate may be achieved by using a thin plate with materials having low stiffness (Young's modulus) and high strength. Materials that have these properties include titanium, a new alloy and glass or graphite reinforced composite materials.

It will be appreciated by those skilled in the art that when the word "driver" is used in this specification in classifying a golf club head, it includes a wood or iron, namely the driver, brassie, spoon, etc., that were made of wood for many years, whereas the remainder of the clubs, the "irons", were made of metal, i.e., wedges and clubs "1" to "9". In present days, "woods" quite often are made of metal and quite often are hollow. Such "woods" may be made of composite materials, i.e., plastic that is filled with fibers of carbon, glass, graphite, boron, etc.

As mentioned, the invention includes maximizing the launch velocity of the ball while staying within the prescribed rules of the USGA.

Figure 4:
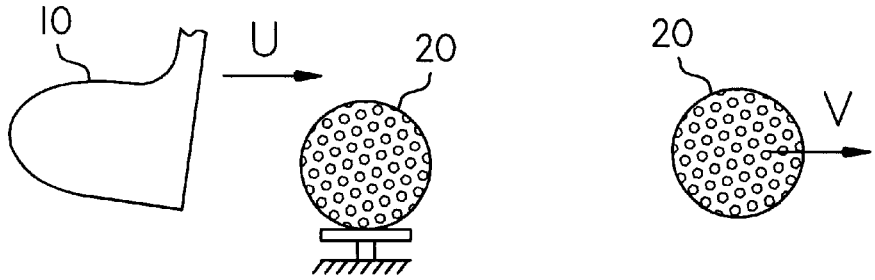
FIGS. 4–6 respectively illustrate a method for determining a coefficient of restitution of the club head of the present invention.
Figure 5:
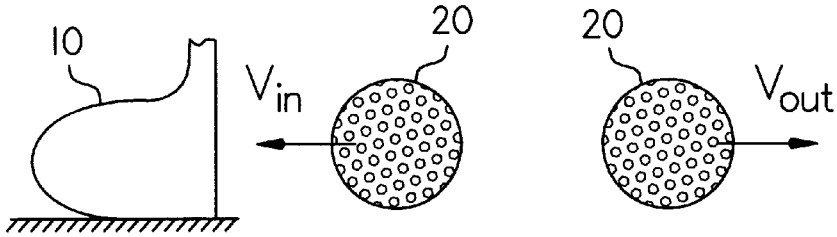
Figure 6:
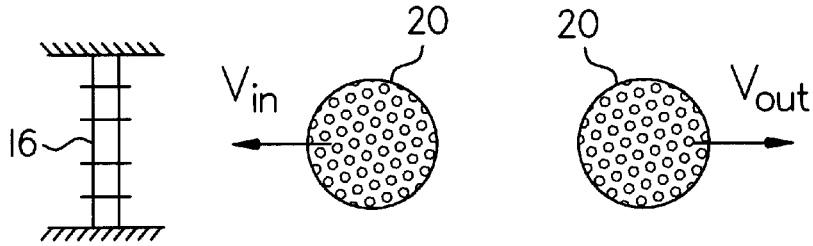

The invention satisfies the USGA rule at high impact velocity of 160 ft/sec, but gives a higher coefficient of restitution than a conventional club head at lower velocity. Three methods are available for determining the coefficient of restitution and the launch velocity of the ball. The three methods are illustrated in FIGS. 4–6. The first method, shown in FIG. 4, is an actual situation. Club head 10, when swung by a player, hits a stationary ball 20. The club head has an impact velocity "U" and ball 20 after impact has a launch velocity "v". Assuming the mass of the club head to be "M" and the mass of the ball to be "m", the following mathematical relationship may be written.

$$v = U1 + \frac{e}{1 + \frac{m}{M}} \tag{1}$$

where e=coefficient of restitution.

It will be noted that a larger "e" provides a larger launch velocity "v".

Since the method shown in FIG. 4 is difficult and expensive to conduct, the USGA has proposed a second method, shown in FIG. 5, wherein the club head is free-standing at zero velocity. Ball 20, however, is launched into club head 10 at a velocity "Vin". The ball rebounds in the opposite direction with a velocity "Vout". Assuming the same respective masses of "M" and "m" the following mathematical relationship may be written:

$$\frac{V_{out}}{V_{in}} = \frac{eM - m}{M + m} \tag{2}$$

where e=coefficient of restitution. It will be noted that when the following substitutions are made in Equation (2)

$$U = v_{in};\ v = Vout + Vin$$

then the second method provides the same result as the first method (Equation (1)). Since the second method is easier and less expensive to conduct, it is preferable for determining the coefficient of restitution, "e".

A third method may be used to determine an approximate coefficient of restitution, as shown in FIG. 6. As a good approximation it may be used during development phase for testing the trampoline plate. As shown, trampoline plate 16 is fixed in position by conventional methods. Ball 20 is launched into plate 16 with a velocity "Vin," and rebounds in the opposite direction with a velocity "Vout". The coefficient of restitution "e" may be approximated from the following equation:

$$e = \frac{Vout}{Vin} \tag{3}$$

The third method thus may be used as an approximation during the design phase, and the second method may be used subsequently to demonstrate that the club head has a coefficient of restitution less than or equal to 0.83 at a velocity "Vin" of 160 ft/sec.

The effectiveness and advantage of using a stopper plate in a club head may be seen by referring to Tables 1–2, showing the results of a finite-element computer simulation using the third method. In the simulation, ball 20 is a pinnacle-gold ball and trampoline plate 16 is titanium with a front face dimension of 3.5 inch by 1.75 inch ellipse. Two different thicknesses of trampoline plates are used –0.12 inch and 0.10 inch. The 0.12 inch trampoline plate does not have a stopper plate behind it, whereas the 0.10 inch trampoline plate does have a stopper plate. The gap between the two plates is 1.9 mm.

TABLE 1

| Without Stopper (trampoline plate thickness = 0.12 inch) | |
|---|---|
| Impact Velocity (ft/sec) | Coefficient of Restitution |
| 160 | 0.830 |
| 120 | 0.838 |

TABLE 2

| With Stopper (trampoline plate thickness = 0.10 inch, gap between plates = 1.9 mm) | |
|---|---|
| Impact Velocity (ft/sec) | Coefficient of Restitution |
| 160 | 0.830 |
| 120 | 0.858 |

Referring to Tables 1–2, it will be appreciated that a plate thickness of 0.12 inch provides a coefficient of restitution of 0.830 at 160 ft/sec; at a lower velocity of 120 ft/sec, the same plate provides a coefficient of restitution of 0.838. The trampoline plate thickness, however, may be reduced to 0.10 inch, if a stopper plate is placed 1.9 mm behind the trampoline plate. At 160 ft/sec, the coefficient of restitution is again 0.830. But at 120 ft/sec, the coefficient of restitution is 0.858, which is larger than the case without the stopper plate. A larger coefficient of restitution provides a higher launch velocity. It will be appreciated, therefore, that by the simple method of placing a stopper plate behind the trampoline plate, a higher ball launch velocity is achieved for a lower swing speed player using a club head that conforms to USGA regulations.

Figure 7A:
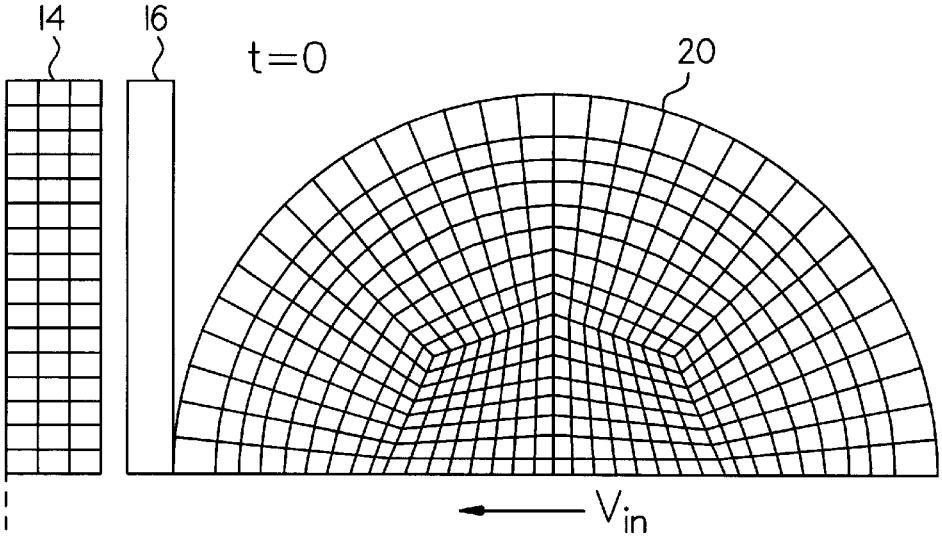
FIGS. 7A–C are schematic representation views of an analytical simulation of a finite element model (FEM) of a golf club head of the present invention striking a golf ball.
Figure 7B:
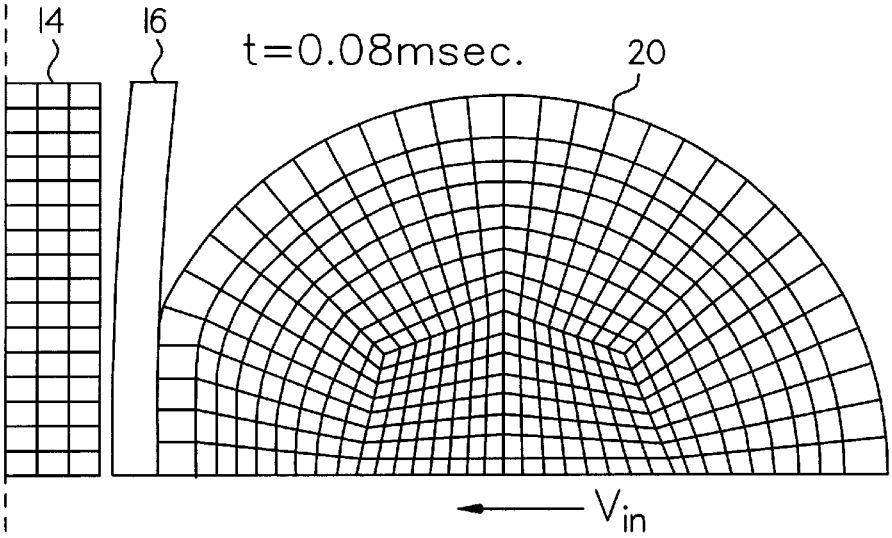
Figure 7C:
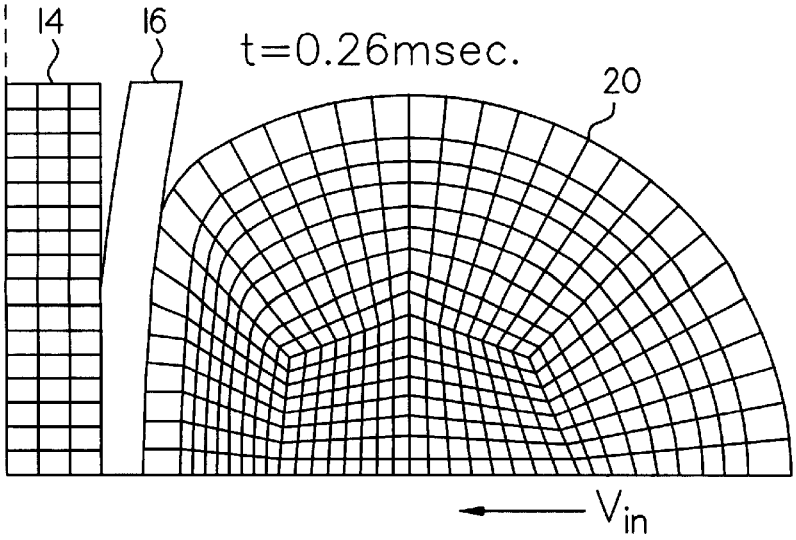

Reference is now made to FIGS. 7A–C showing the deformation of ball 20 and trampoline plate 16 at three different times during a 160 ft/sec impact. FIG. 7A depicts the instant of impact at time t=0. FIG. 7B depicts the trampoline plate deflecting toward stopper plate 14 at time t=0.08 msec. Finally, FIG. 7C depicts the maximum deflection of the trampoline plate at time t=0.26 msec, as it is arrested by stopper plate 14.

Figure 8:
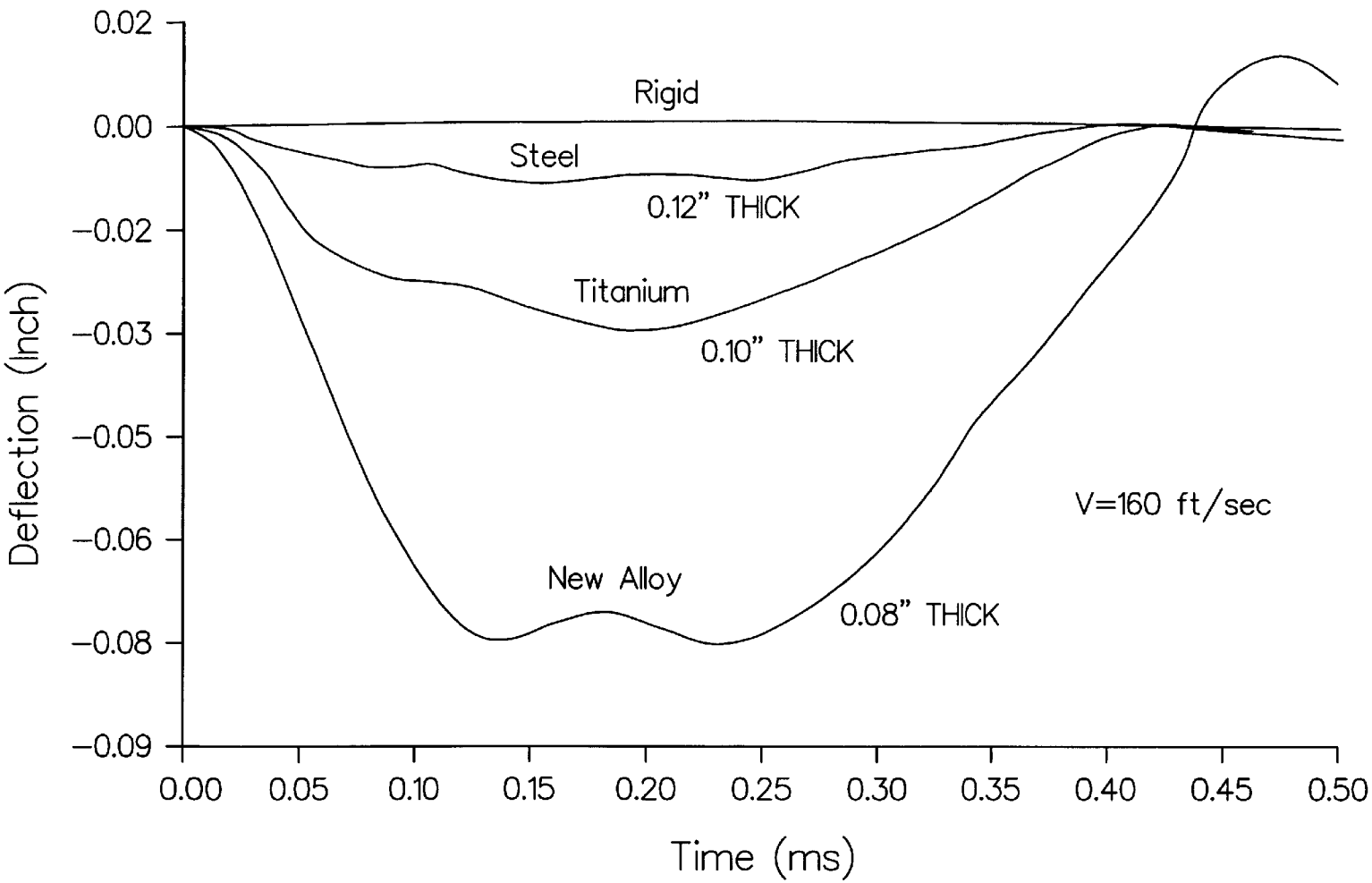
FIG. 8 is a time history plot of deflection versus time for various trampoline plates of a golf club head taken during an analytical simulation FEM.

Deflection of each plate as a function of time is illustrated in FIG. 8. Note that the plate deflection is inversely proportional to the plate thickness. In addition, as the plate deflection increases, the ball deflection is correspondingly decreased resulting in a higher coefficient of restitution and a higher launch velocity.

Figure 9:
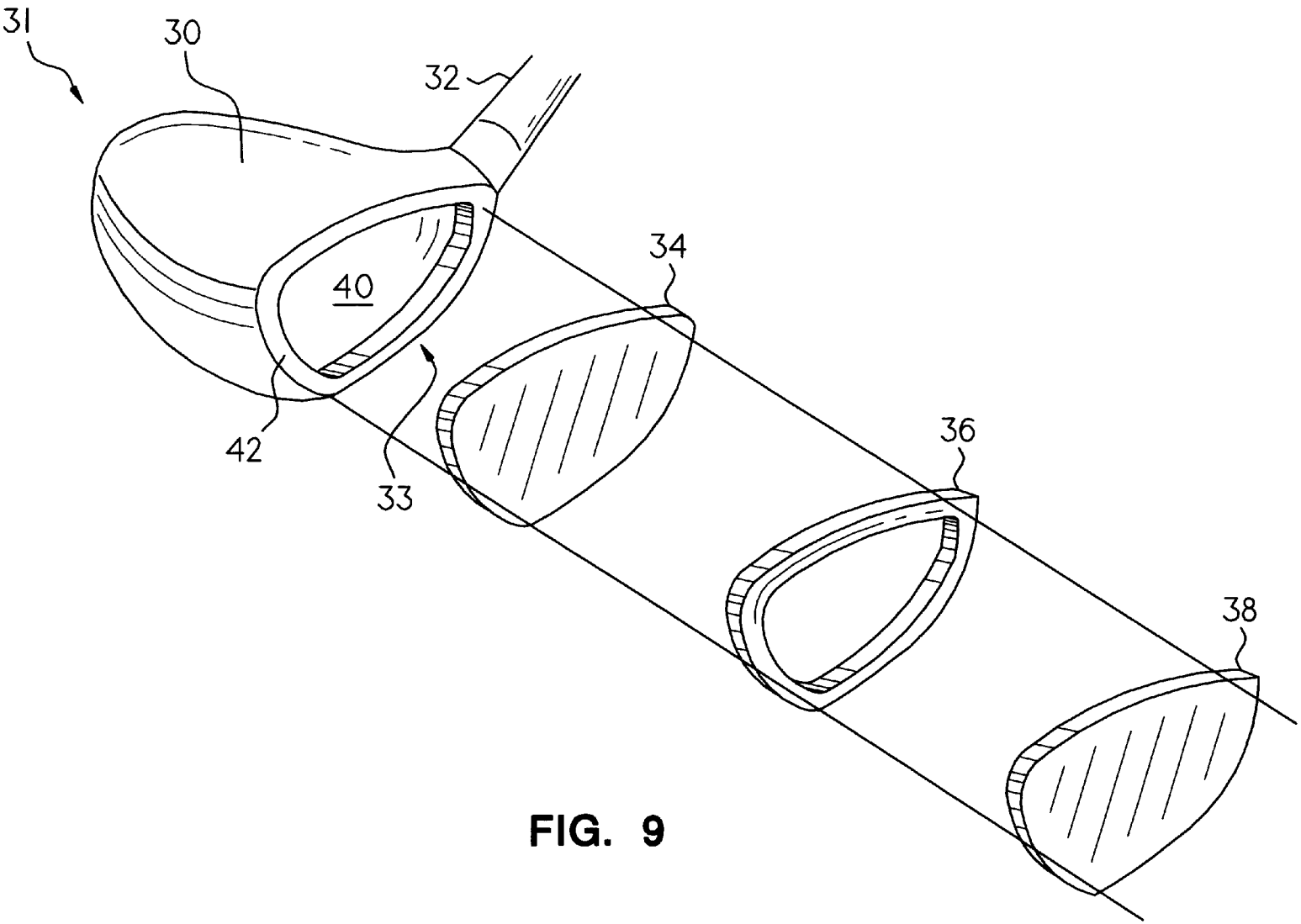
FIG. 9 is a perspective view, in exploded form, of a club head forming an embodiment of the invention.

Turning now to FIG. 9, an exemplary embodiment of a golf club head, in the form of a wood, is generally identified as 30. The head is substantially hollow, having a rear end 31, a front end 33 and a chamber 40. Chamber 40 is defined by an inner surface generally in the shape of the club head. A framed opening 42 is provided at the front end. A hosel 32 projects upwardly from the top wall of club head 30. A stopper plate 34, which is of sufficient thickness to form a rigid and stiff wall for arresting the deformation of the trampoline plate, is secured to the front end in conventional manner (not shown). Stopper plate 34 is preferably made of titanium and has a thickness of 0.15 inch. Other materials and thicknesses may be selected for the stopper plate, the prime consideration being to achieve a stopper plate that is stiff and rigid.

Spacer 36 made of metal or composite materials forms a frame contoured to the edges of stopper plate 34. Spacer 36 is substantially open, as shown. The thickness of spacer 36 may be varied depending on the desired gap width, as previously explained. Of course, the desired gap width is of a predetermined distance between stopper plate 34 and trampoline plate 38. Spacer 36 is secured to stopper plate 34 and club head 30 in a conventional manner (not shown).

Lastly, trampoline plate 38 formed from metal or composite material is secured to the club head in a conventional manner (not shown). It will be appreciated that trampoline plate 38, spacer 36, stopper plate 34 and club head 30 may be secured with a set of screws.

The preferred material selected for trampoline plate 38 may be titanium, a new alloy or glass reinforced composite with thicknesses of 0.10 inch, 0.08 inch and 0.12 inch, respectively. Furthermore, if a 0.10 inch titanium plate is selected, spacer 36 should be of a thickness that allows a 0.075 inch gap between the trampoline plate and the stopper plate. If a 0.08 inch new alloy plate is selected, spacer 36 should allow a 0.126 inch gap; if a 0.12 inch glass reinforced composite plate is selected, spacer 36 should allow a 0.307 inch gap. The properties of these trampoline plates and their required gaps from the stopper plate are summarized in Table 3. It will be understood that the new alloy shown in Table 3 includes any material or materials combined to produce the properties shown in the table.

TABLE 3

Material properties for selected trampoline plates and spacer gaps.

| | Properties | | | | Coef of |
|---|---|---|---|---|---|
| Trampoline Plate Material | Thickness (inch) | Young's Modulus (PSI) | Yield Strength (PSI) | Gap (inch) | Restitution at 120 ft/sec |
| Titanium | 0.10 | $15.5 \times 10^6$ | $285 \times 10^3$ | 0.075 | 0.858 |
| New Alloy | 0.08 | $13.8 \times 10^6$ | $406 \times 10^3$ | 0.126 | 0.884 |
| Glass Composite | 0.12 | $8.7 \times 10^6$ | $485 \times 10^3$ | 0.307 | 0.876 |

For each of the trampoline plates shown in Table 3, the stopper plate is preferably made from titanium and has a thickness of 0.15 inch. Although not shown in the table, it is understood that the coefficient of restitution of each selected embodiment is 0.83 at 160 ft/sec ball impact velocity.

In an alternative embodiment (not shown), spacer 36 is not used and stopper plate 34 is attached to the inner surface of the club head at a desired gap width from the front end of the club. The stopper plate may be attached by conventional methods, such as bonding or welding. Trampoline plate 38 is attached by conventional methods to the framed opening 42 on the front end of the club head. In this manner, the desired gap width has a predetermined distance between stopper plate 34 and trampoline plate 38, without the need for a spacer.

Figure 10A:
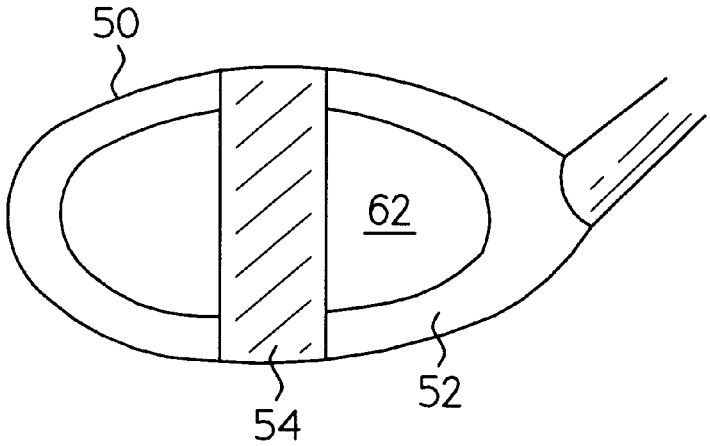
FIGS. 10A–D are cross-sectional views illustrating different embodiments for the stopper plate of the invention.
Figure 10B:
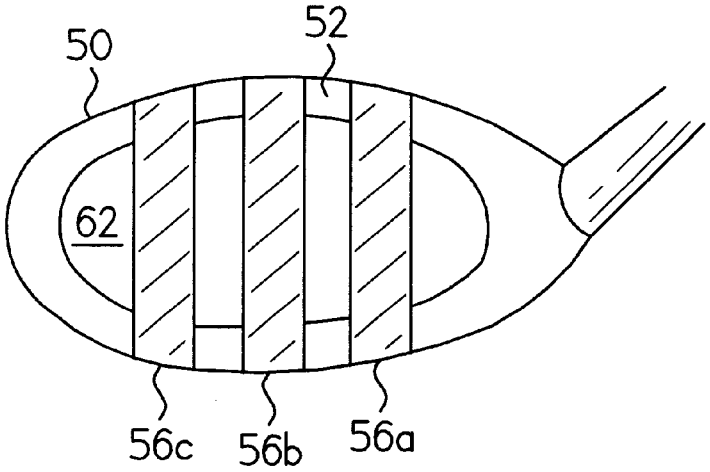
Figure 10C:
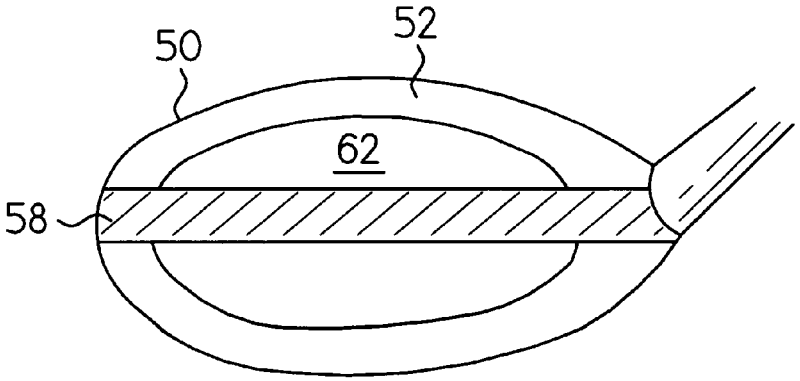
Figure 10D:
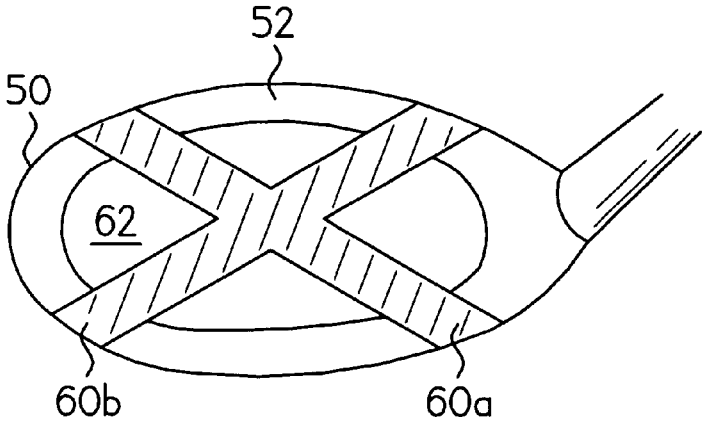

While a solid stopper plate and a solid trampoline plate have been shown in the exemplary embodiment of FIG. 9, it will be appreciated that other embodiments may be adapted for use with a club head. For example, different embodiments are shown in FIGS. 10A–D. Particularly, a club head 50 is provided with a chamber 62 and a framed-opening 52. Instead of a solid stopper plate spanning the entire front end of the club head, strip-sectional stopper plates are shown in FIGS. 10A–D. For example, FIG. lOA depicts stopper plate 54 comprising a vertical strip secured in a conventional fashion to framed-opening 52. FIG. 10B depicts a stopper plate formed from three vertical strips 56*a–c*; and FIG. 10C depicts a stopper plate formed from a horizontal strip 58. Lastly, FIG. 10D depicts a stopper plate formed from two strips 60*a* and 60*b* secured to framed-opening 52 in an X-configuration. The strips may be formed from metal or other composite materials, but are preferably made from titanium.

Although not shown in FIGS. 10A–D, it will be appreciated to those skilled in the art that a suitable spacer may be secured to club head 50 to provide the desired gap between the stripped stopper plates and the trampoline plate. It will also be appreciated that the stopper plates may be bonded or welded to the inner surface of the club head within chamber 62 at a predetermined distance from framed-opening 52. In this latter embodiment the spacer need not be used.

Figure 11:
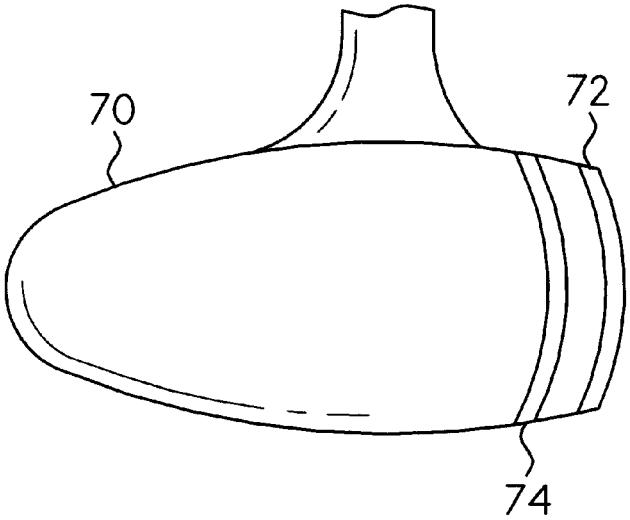
FIG. 11 is cross-sectional view of another embodiment of the invention.

Still another embodiment of the invention is shown in FIG. 11. As shown, club head 70 has a curved trampoline plate 72 and a curved stopper plate 74 formed at the front end of the club head. It will be appreciated that curved trampoline plate 72 may be a curved plate of conventional design disposed at the front end of the club head. The curvature may extend from top to sole and from heel to toe of the club head. Moreover, stopper plate 74 is formed with a curved surface that matches and substantially parallels the curvature of trampoline plate 72. Attachments of trampoline plate 72 and stopper plate 74 to club head 70 may be by conventional methods. The gap width formed between the two plates depends on the material used for the plates, as has been described before. It will also be understood that stopper plate 74 may be the front end of the club head and trampoline plate 72 may be disposed forwardly of the stopper plate by a spacer (not shown). It will also be understood that trampoline plate 72 may be the front end of the club head and stopper plate 74 may be disposed rearwardly of trampoline plate 74, in a manner similar to that described previously.

Similar to the embodiment shown in FIG. 11, wherein the stopper plate is formed with a curved surface, the strip-sectional stopper plates, shown in FIGS. 10A–D, may also be formed as curved surfaces that substantially parallel the curvature of a curved trampoline plate (not shown).

Those skilled in the art will appreciate that the above-described preferred embodiments are subject to numerous modifications and adaptations without departing from the scope and spirit of the invention. Therefore, it is to be understood that, within the scope of the appended claims, the invention may be practiced other than as specifically described herein. For example, the stopper plate need not be separate and distinct from the front end of the golf club head. In a golf club head that is substantially solid and does not have an opening with a chamber, the stopper plate may be the front end.

What is claimed:

1. A golf club head comprising a stopper plate disposed at a front end of said golf club head, a trampoline plate for impacting a golf ball disposed a predetermined distance forwardly of said stopper plate, said trampoline plate deflecting in a direction toward said stopper plate and rebounding in a direction away from said stopper plate when said trampoline plate impacts the golf ball, and said stopper plate arresting deflection of said trampoline plate;

said trampoline plate (a) deflecting toward said stopper plate, free of being arrested by said stopper plate, when impacting the golf ball at a velocity less than 160 ft/sec, and (b) being arrested by said stopper plate, when impacting the golf ball at a velocity greater than 160 ft/sec, and said predetermined distance substantially equal to a deflection distance of said trampoline plate, and said deflection distance determined by said trampoline plate impacting the golf ball at the velocity of 160 ft/sec, when the trampoline plate is free of being arrested by said stopper plate.

2. The golf club head of claim 1 having a first coefficient of restitution value substantially determined by striking said golf ball with a first impact velocity and a second coefficient of restitution value substantially determined by striking said golf ball with a second impact velocity, wherein said first impact velocity is a maximum value, said second impact velocity is a smaller value, and said first coefficient of restitution value is smaller than said second coefficient of restitution value.

3. The golf club head of claim 2 wherein said first coefficient of restitution value is 0.83 and said first impact velocity is 160 ft/sec.

4. The golf club head of claim 2 wherein a gap is formed between said trampoline plate and said stopper plate, said gap is of a width sufficient to permit said trampoline plate to deflect freely toward said stopper plate when striking said golf ball at an impact velocity smaller than said first impact velocity.

5. The golf club head of claim 1 wherein said stopper plate is of a thickness sufficient to arrest said deflection of said trampoline plate when striking said golf ball at an impact velocity of 160 ft/sec.

6. The golf club head of claim 5 wherein said stopper plate is titanium and has a thickness of 0.15 inch.

7. The golf club head of claim 1 wherein said trampoline plate is comprised of a material selected from a group consisting of titanium material, new alloy material and glass reinforced composite material.

8. The golf club head of claim 7 wherein said trampoline plate is of a thickness having a coefficient of restitution value greater than 0.83 when impacting said golf ball with a velocity less than 160 ft/sec.

9. The golf club head of claim 1 wherein said trampoline plate is characterized by a coefficient of restitution of 0.83, when impacting the golf ball at a velocity of 160 ft/sec.

10. A golf club head having a front end forming a face comprising a trampoline plate disposed forwardly of said front end and forming a gap of a predetermined distance between said trampoline plate and said front end, said trampoline plate deflecting in a direction toward said front end and rebounding in a direction away from said front end when striking a golf ball said trampoline plate (a) deflecting, toward said front end, free of being arrested by said front end, when impacting the golf ball at a velocity less than 160 ft/sec, and (b) being arrested by said front end, when impacting the golf ball at a velocity greater than 160 ft/sec; and said predetermined distance substantially equal to a deflection distance of said trampoline plate, and said deflection distance determined by said trampoline plate impacting the golf ball at the velocity of 160 ft/sec, when said trampoline plate is free of being arrested by said front end.

11. The golf club head of claim 10 wherein said gap is formed by a spacer disposed between said front end and said trampoline plate.

12. The golf club head of claim 10 having a first coefficient of restitution value substantially determined by striking said golf ball with a first impact velocity and a second coefficient of restitution value substantially determined by striking said golf ball with a second impact velocity, wherein said first impact velocity is a maximum value, said second impact velocity is a smaller value, and said first coefficient of restitution value is smaller than said second coefficient of restitution value.

13. The golf club head of claim 12 wherein said first coefficient of restitution is 0.83 and said first impact velocity is 160 ft/sec.

14. The golf club head of claim 13 wherein said gap is of a width sufficient to permit said trampoline plate to deflect freely toward said front end when striking said golf ball at an impact velocity smaller than said first impact velocity.

15. The golf club head of claim 10 wherein said trampoline plate has a deflection that is inversely proportional to a thickness of said trampoline plate.

16. The golf club head of claim 10 wherein said trampoline plate is characterized by a coefficient of restitution of 0.83, when impacting the golf ball at a velocity of 160 ft/sec.

17. A method of controlling launch velocity of a golf ball when struck by a golf club head comprising the steps of:

a) forming a rigid surface at a front end of the golf club head, b) forwardly spacing a plate at a predetermined distance from the rigid surface, wherein the plate deflects in a direction toward the rigid surface and then rebounds in a direction away from the rigid surface when striking the golf ball;

c) measuring a deflection distance of the plate by striking the golf ball at an impact velocity of 160 ft/sec, when the plate is free of touching the rigid surface; and d) spacing the plate at the predetermined distance substantially equal to the measured deflection distance.

18. The method of claim 17 further including the step of (e) providing a coefficient of restitution of 0.83 to the plate when striking the golf ball at an impact velocity of 160 ft/sec.

* * * * *

UNITED STATES PATENT AND TRADEMARK OFFICE

CERTIFICATE OF CORRECTION

PATENT NO. : 6,165,081
DATED : December 26, 2000
INVENTOR(S) : Pei Chi Chou

It is certified that error appears in the above-identified patent and that said Letters Patent is hereby corrected as shown below:

Column 4,
Line 37, delete the equation " $v = U1 + \frac{e}{1 + \frac{m}{M}}$ (1) "

And substitute therefor -- $v = U \frac{1 + e}{1 + \frac{m}{M}}$ (1) --

Signed and Sealed this

Fifth Day of February, 2002

*Attest:*

*Attesting Officer*

JAMES E. ROGAN
*Director of the United States Patent and Trademark Office*